US009371649B2

(12) United States Patent
Cipriani

(10) Patent No.: US 9,371,649 B2
(45) Date of Patent: Jun. 21, 2016

(54) SUPPORT METAL STRUCTURE OF A FALSE CEILING

(71) Applicant: Giuseppe Cipriani, Rovereto (IT)

(72) Inventor: Giuseppe Cipriani, Rovereto (IT)

(73) Assignee: Giuseppe Cipriani, Rovereto (IT)

( * ) Notice: Subject to any disclaimer, the term of this patent is extended or adjusted under 35 U.S.C. 154(b) by 0 days.

(21) Appl. No.: 14/653,263

(22) PCT Filed: Feb. 12, 2014

(86) PCT No.: PCT/IB2014/058999

§ 371 (c)(1),
(2) Date: Jun. 17, 2015

(87) PCT Pub. No.: WO2014/125441

PCT Pub. Date: Aug. 21, 2014

(65) Prior Publication Data

US 2015/0337532 A1 Nov. 26, 2015

(30) Foreign Application Priority Data

Feb. 14, 2013 (IT) ..... VR2013A0040

(51) Int. Cl.
*E04B 9/10* (2006.01)
*E04B 9/06* (2006.01)
*E04B 9/12* (2006.01)

(52) U.S. Cl.
CPC . *E04B 9/10* (2013.01); *E04B 9/067* (2013.01); *E04B 9/127* (2013.01); *E04B 9/068* (2013.01); *E04B 2103/06* (2013.01)

(58) Field of Classification Search
CPC ..... E04B 9/06; E04B 9/122; E04B 9/12; E04B 9/16; E04B 9/067; E04B 9/127; E04B 9/068; E04B 2103/06
USPC ..... 52/506.1, 506.05, 506.06, 506.09, 664, 52/665, 668
See application file for complete search history.

(56) References Cited

U.S. PATENT DOCUMENTS
1,253,216 A 1/1918 Day
3,312,488 A 4/1967 Lickliter et al.
(Continued)

FOREIGN PATENT DOCUMENTS
AU 4226878 6/1979
DE 4431849 A1 3/1996
(Continued)

OTHER PUBLICATIONS
PCT International Search Report mailed on May 13, 2014 for PCT/IB2014/059535 filed on Mar. 7, 2014 in the name of Giuseppe Cipriani.
PCT Written Opinion mailed on May 13, 2014 for PCT/IB2014/059535 filed on Mar. 7, 2014 in the name of Giuseppe Cipriani.
PCT International Preliminary Report on Patentability mailed on Apr. 17, 2015 for PCT/IB2014/059535 filed on Mar. 7, 2014 in the name of Giuseppe Cipriani.
(Continued)

*Primary Examiner* — Beth Stephan
(74) *Attorney, Agent, or Firm* — Steinfl & Bruno LLP

(57) ABSTRACT

A metal profile for a false ceiling and support structure for a false ceiling including at least one pair of metal profiles is described. The metal profile includes a main portion and an integral engaging member connected as a single body, or as one piece, to at least one end of the main portion, wherein said integral engaging member includes a plate-like portion and an engaging tongue or fin connected as one piece to the plate-like portion, wherein said engaging tongue or fin is detached or separated from said plate-like portion on at least two sides of the engaging tongue so as to define a cut profile shaped like a "7". The engaging tongue or fin is displaceable by means of elastic deformation between a first position in which the engaging tongue is located protruding from a plane of the plate-like portion, and a second position in which said engaging tongue is displaced towards the plane of the plate-like portion.

19 Claims, 13 Drawing Sheets

(56) References Cited

U.S. PATENT DOCUMENTS

| | | | | | |
|---|---|---|---|---|---|
| 3,321,879 | A * | 5/1967 | Purdy | E04B 9/122 52/232 |
| 3,396,997 | A * | 8/1968 | Adams | E04B 9/122 403/326 |
| 3,501,185 | A * | 3/1970 | Downing, Jr. | E04B 9/122 403/252 |
| 3,606,417 | A * | 9/1971 | Rousey | E04B 9/122 403/219 |
| 3,746,379 | A * | 7/1973 | Sauer | E04B 9/122 403/2 |
| 3,922,829 | A * | 12/1975 | Sauer | E04B 9/122 52/667 |
| 3,979,874 | A | 9/1976 | Cubbler, Jr. et al. | |
| 4,489,529 | A | 12/1984 | Ollinger et al. | |
| 4,658,502 | A | 4/1987 | Eckold et al. | |
| 5,271,202 | A | 12/1993 | Vukmanic et al. | |
| 5,577,313 | A | 11/1996 | Guido et al. | |
| 5,687,525 | A | 11/1997 | Koski et al. | |
| 5,979,055 | A | 11/1999 | Sauer et al. | |
| 6,047,511 | A | 4/2000 | Lehane et al. | |
| 6,138,416 | A | 10/2000 | Platt | |
| 6,523,314 | B1 | 2/2003 | Lalonde et al. | |
| 6,729,100 | B2 * | 5/2004 | Koski | E04B 9/068 403/346 |
| 7,762,034 | B2 | 7/2010 | Jankovec et al. | |
| 7,797,903 | B2 | 9/2010 | Lehane, Jr. | |
| 8,590,248 | B2 | 11/2013 | Lehane, Jr. et al. | |
| 8,715,427 | B2 | 5/2014 | Vandeputte et al. | |
| 9,212,484 | B2 | 12/2015 | Cipriani | |
| 2003/0154686 | A1 | 8/2003 | Platt | |
| 2003/0200719 | A1 | 10/2003 | Harcula et al. | |
| 2006/0260246 | A1 * | 11/2006 | LaLonde | E04B 9/10 52/506.07 |
| 2007/0028554 | A1 | 2/2007 | Ferrell et al. | |
| 2008/0245018 | A1 | 10/2008 | Miller et al. | |
| 2010/0077687 | A1 | 4/2010 | Jankovec et al. | |
| 2013/0061550 | A1 * | 3/2013 | Underkofler | E04F 13/0803 52/506.05 |

FOREIGN PATENT DOCUMENTS

| | | | |
|---|---|---|---|
| DE | 10211257 | A1 | 9/2003 |
| EP | 0940514 | | 9/1999 |
| EP | 1239095 | A2 | 9/2002 |
| EP | 1762663 | | 3/2007 |
| EP | 2447434 | A1 | 5/2012 |
| EP | 2532799 | A1 | 12/2012 |
| GB | 1369234 | | 10/1974 |
| GB | 2133819 | | 8/1984 |
| GB | 2145752 | | 4/1985 |
| GB | 2274080 | | 7/1994 |
| WO | 99/46460 | A1 | 9/1999 |
| WO | 2007039542 | A1 | 4/2007 |
| WO | 2012/18223 | A1 | 9/2012 |
| WO | 2013/068937 | | 5/2013 |
| WO | 2013/175268 | A1 | 11/2013 |
| WO | 2014/016648 | | 1/2014 |
| WO | 2014/016648 | A1 | 1/2014 |

OTHER PUBLICATIONS

PCT International Search Report mailed on May 13, 2014 for PCT/IB2014/058999 filed on Feb. 14, 2014 in the name of Giuseppe Cipriani.

PCT Written Opinion mailed on May 13, 2014 for PCT/IB2014/058999 filed on Feb. 14, 2014 in the name of Giuseppe Cipriani.

PCT International Preliminary Report on Patentability mailed on Apr. 29, 2014 for PCT/IB2014/058999 filed on Feb. 14, 2014 in the name of Giuseppe Cipriani.

PCT International Search Report mailed on Apr. 2, 2013 for PCT/IB2012/053862 filed on Jul. 27, 2012 in the name of Giuseppe Cipriani.

PCT Written Opinion mailed on Apr. 2, 2013 for PCT/IB2012/053862 filed on Jul. 27, 2012 in the name of Giuseppe Cipriani.

PCT International Preliminary Report on Patentability mailed on Dec. 12, 2014 for PCT/IB2012/053862 filed on Jul. 27, 2012 in the name of Giuseppe Cipriani.

Non-Final Office Action issued for U.S. Appl. No. 14/653,255, filed Jun. 17, 2015 in the name of Giuseppe Cipriani. Mail date: Oct. 21, 2015. 12 pages.

Non-Final Office Action issued for U.S. Appl. No. 14/354,546, filed Apr. 25, 2014 in the name of Giuseppe Cipriani. Mail date: Feb. 23, 2015. 13 pages.

Notice of Allowance issued for U.S. Appl. No. 14/354,546, filed Apr. 25, 2014 in the name of Giuseppe Cipriani. Mail date: Sep. 28, 2015. 8 pages.

First Office Action issued for Chinese Patent Application No. 201280059686.0 filed in Giuseppe Cipriani. Mail date: Jul. 15, 2015 (English Translation pp. 1-3 + Original) 10 pages.

Office Action issued for Chilean Patent Application No. 1180-2014 filed in the name of Giuseppe Cipriani. Date: Apr. 1, 2015 (English Summary + Original Office Action) 13 pages.

PCT International Search Report mailed on Jul. 12, 2013 for PCT Application PCT/IB2012/056221 filed on Nov. 7, 2012 in the name of Giuseppe Cipriani. 4 pages.

PCT Written Opinion mailed on Dec. 2, 2013 for PCT Application PCT/IB2012/056221 filed on Nov. 7, 2012 in the name of Giuseppe Cipriani. 5 pages.

PCT Written Opinion mailed on Jan. 22, 2014 for PCT Application PCT/IB2012/056221 filed on Nov. 7, 2012 in the name of Giuseppe Cipriani. 8 pages.

PCT International Preliminary Report on Patentability mailed on Apr. 10, 2014 for PCT Application PCT/IB2012/056221 filed on Nov. 7, 2012 in the name of Giuseppe Cipriani. 36 pages.

PCT International Search Report mailed on Jul. 26, 2012 for PCT Application PCT/IB2011/055051 filed on Nov. 11, 2011 in the name of Giuseppe Cipriani. 9 pages.

SSAB Swedish Steel Group. "It's All About Strength and Lightness." DOCOL. 32 pgs. Aug. 2008.

DOCOL—High Strength Steel. "Docol Roll—Cold rolled high strength steel for roll forming." 2 pgs. Apr. 9, 2011.

World Auto Steel. Advanced High Strength Steel (AHSS) Application Guidelines. Version 4.1. 338 pgs. Jun. 8, 2009.

Masaaki, M. et al. "Method for Bending Sheet Metal and Product of Sheet Metal." Translation of specification WO2012118223 (A1) published on Sep. 7, 2012. 52 pages.

Response to Written Opinion dated Nov. 14, 2013 for PCT Application PCT/IB2012/056221 filed on Nov. 7, 2012 in the name of Giuseppe Cipriani. 14 pages.

Response to Written Opinion dated Mar. 7, 2014 for PCT Application PCT/IB2012/056221 filed on Nov. 7, 2012 in the name of Giuseppe Cipriani. 44 pages.

Manfrin, M. "To: Ms. Manfrin—Application of Cipriani Giuseppe—your ref BW74E/EMM/emm." Email to Jan Demeester. Mar. 13, 2014. 4 pages.

Demeester, J. "To: Ms. Manfrin—Application of Cipriani Giuseppe—your ref BW74E/EMM/emm." Email to Marta Manfrin. Mar. 13, 2014. 1 page.

PCT Written Opinion mailed on Jul. 12, 2013 for PCT Application PCT/IB2012/056221 filed on Nov. 7, 2012 in the name of Giuseppe Cipriani. 5 pages.

PCT Written Opinion mailed on Jul. 26, 2012 for PCT Application PCT/IB2011/055051 filed on Nov. 11, 2011 in the name of Giuseppe Cipriani. 5 pages.

PCT International Preliminary Report on Patentability mailed on May 13, 2014 for PCT Application PCT/IB2012/056221 filed on Nov. 7, 2012 in the name of Giuseppe Cipriani. 6 pages.

Amendment and Response for U.S. Appl. No. 14/354,546, filed Apr. 25, 2014 on behalf of Giuseppe Cipriani. Submitted Aug. 18, 2015. 46 pages.

Declaration for U.S. Appl. No. 14/354,546, filed Apr. 25, 2014 on behalf of Giuseppe Cipriani. Submiited Aug. 18, 2015. 34 pages.

* cited by examiner

SUPPORT METAL STRUCTURE OF A FALSE CEILING

CROSS REFERENCE TO RELATED APPLICATIONS

The present application is the US national stage entry of International Patent Application No. PCT/IB2014/058999, filed on Feb. 14, 2014, which, in turn, claims priority to Italian Application No. VR2013A000040, filed on Feb. 14, 2013.

The present disclosure relates in general to the sector of support structures or load-bearing structures for false ceilings, namely support structures for sheets or panels, for example of the modular type, which are arranged underneath an actual ceiling and are connected to the ceiling by means of a so-called hanger, steel profiles, iron wire, sections or other connecting accessories.

The support structures for false ceilings comprise a frame intended to support or hold panels or sheets, wherein the frame includes metal profiles joined together and intersecting by means of a special interlocking joint so as to form ideally a grid which forms a support surface for the panels or sheets.

Even more particularly, the present disclosure relates to a metal profile.

It is known that a metal profile for structures for supporting false ceilings is an article with an elongated form having a cross-section with a T-shape or other shape suitable for a false ceiling, for example a modular false ceiling, in which the profile is obtained by means of folding of a metal sheet or strip.

The metal profile is provided, at one of its ends, with an integral engaging member. In other words, the profile is provided with an end connecting part made as one piece with the profile, and therefore without use of an associated clip, this single-piece end part or integral engaging member allowing a connection to a second metal profile to be obtained.

The present disclosure is based on the recognition by the inventor that, in relation to this field of application and the aforementioned metal profiles, the integral engaging member must ensure a connection to the second profile which provides an adequate mechanical strength suitable for ensuring in turn secure interlocking between the profiles.

It is also required that there should be the possibility of connecting and where necessary disconnecting easily the integral engaging member from the second metal profile during assembly/disassembly of the support frame.

In fact, it should be considered that, during assembly/disassembly of the false-ceiling frame by an operator, normally the operator does not have a clear view of the integral engaging member, since, often the operator is working from below, with his/her arms extending upwards, and it is therefore difficult for the operator to be able to see when an integral engaging member is correctly engaged or disengaged with/from another metal profile.

In particular, the present disclosure is based on the recognition by the inventor that at present, when an integral engaging member is released, an operator must use an instrument or tool, such as a screwdriver, in order to release temporarily the integral engaging member from the other metal profile, for example by exerting a pulling action on the integral engaging member. During release, the integral engaging member may be subject to an excessive force exerted by the tool used, to the point that the material may even yield, thereby making it impossible or difficult to reuse the integral engaging member and therefore the entire profile. Furthermore, owing to the poor visibility available when carrying out the operations, an operator is operating under uncertain conditions since, not being able to see the integral engaging member, he/she is often obliged to use the aforementioned tool in a random manner or exert manual force.

The document GB2145752A describes a profile in which a plate-like engaging portion has an engaging tongue intended to be engaged inside a slot in a second profile arranged in an intersecting manner at right angles to the first profile. The engaging tongue is intended to interfere with a counter-engaging edge of the second profile defining the slot. The engaging tongue has a substantially quadrangular shape with one hinged side arranged substantially at right angles to the longitudinal direction of the metal profile, and three cut sides. The hinge side is directed towards a free end zone of the first profile, while the three cut sides are directed towards the inner zone of the first profile. In this way, when the engaging tongue is inserted inside the slot, the hinge side is inserted firstly inside the slot and acts as a guiding element for insertion. The counter-engaging edge of the second profile defining the slot therefore slides along the surface of the engaging tongue. Once engaged, the three cut sides of the engaging tongue act as engaging sides.

The author of the present disclosure has noted that, in the document GB2145752A, in such an engaged condition, in order to be able to ensure stable engagement, it is necessary to use a profile with a large sheet-metal thickness, for example 0.3 mm. In fact, otherwise, without a large thickness, the three free edges of the engaging tongue, when subjected to tension and stress, for example in a direction opposite to the engaging direction, could be subjected to folding and therefore yield. As a result, considering the thicknesses, in this case also, in order to be able to release such a large-thickness engaging tongue, it is required to use a tool. And, as mentioned, using the tool, results in irreversible deformation of the tongue, so much so that, if the profile is to be used again, this tongue must be repositioned correctly using the tool.

The present disclosure therefore departs from the technical problem of providing a metal profile for a false ceiling which is able to overcome the aforementioned drawbacks with reference to the prior art and/or achieve further advantages or characteristic features.

This technical problem may be solved by means of a profile for a false ceiling according to claim 1 and a support structure for a false ceiling according to claim 17. Particular embodiments of the subject of the present disclosure are defined in the corresponding dependent claims.

In particular a metal profile for a false ceiling is provided, said profile including a main portion and an integral engaging member connected as one piece or as a single body to one end of the main portion, wherein said integral engaging member includes a plate-like portion and an engaging tongue or fin connected as one piece to the plate-like portion, wherein said engaging tongue or fin is detached or separated from said plate-like portion on two cut sides of said engaging tongue and is displaceable by means of elastic deformation between a first position in which the engaging tongue protrudes from a plane of the plate-like portion and a second position in which said engaging fin is displaced towards the plane of the plate-like portion, and vice versa.

In accordance with the present disclosure, separation of the engaging tongue from the plate-like portion on at least two sides provides the engaging tongue with optimum elastic return properties which allow both a stable engagement with a second metal profile and easy release from the metal profile. In fact it can be noted that, in a rest condition, the tongue is displaced laterally or protrudes from the plane of the plate-like portion, and is displaced towards the plane of the plate-like portion at the time of engagement or release.

More particularly, during an engaging step, owing to the elastic deformability of the engaging tongue, the latter is momentarily pressed against the other metal profile, until engagement is obtained when the engaging tongue reaches, for example, a corresponding free edge, or counter-engaging edge, of the other profile, or second profile.

During disassembly of the support structure for false ceilings, it is merely required to press, albeit manually, the engaging tongue in order to reposition it momentarily in the plane of the plate-like portion, and then displace it with respect to the counter-engaging edge of the second profile so as to allow release.

In order to favour the mobility and at the same time engagement, the two cut or separating sides of said engaging tongue are adjacent and intersecting so as to form an angle, and the tongue has a single side connected to the plate-like portion. The connecting side is a hinge side for the engaging tongue and therefore for the two separating or cut sides. The angle may be acute or, in other embodiments, it may be a right angle. Consequently the engaging tongue has a substantially triangular shape and therefore has a profile shaped substantially like a "7".

Even more particularly, with reference to the engaging tongue, it is arranged so that one of the two cut sides, or first cut side, is situated directed towards a free end edge of the profile and has a first free end connected to a first free end of the other separating side, or second cut side, so as to define the aforementioned angle, and a second end connected to the hinge side. For example, in one embodiment, the first cut side and the hinge side converge towards a free edge end of the profile.

The second cut side, which is intended to act as an element for engaging with the counter engaging element of the other profile, is instead arranged, with respect to the first cut side, towards an inner or central zone of the metal profile. In other words, the first cut side, which is located towards the free edge of the plate-like portion, and not intended to engage with the counter-engaging edge of the second profile, has a free end connected to a free end of the other cut side and en end connected to the hinge side. Similarly, the second cut side, which is located towards the inner-lying zone of the plate-like portion and is intended to act as an element for engaging with the counter engaging element of the other profile, has a free end connected to a free end of the first cut side and an end connected to the hinge side.

On the basis of the geometrical layout of the parts described above, the hinge side, unlike the prior art, is no longer at right angles to the longitudinal direction. The hinge side may be both parallel and oblique with respect to the longitudinal direction of the profile, as described below.

This arrangement is such that the engaging tongue has a surface wall inclined towards the free end edge of the profile so as to allow practical insertion and engagement of the engaging tongue. In fact, in order to engage the engaging tongue, the counter-engaging edge of the second profile may slide on the wall of the engaging tongue, which acts as a inclined surface or guiding surface for the counter-engaging edge of the second profile, thereby assisting sliding of the counter-engaging edge of the second profile along the engaging tongue and consequent guiding towards engagement of the engaging tongue.

The engagement occurs, as mentioned, between the counter-engaging edge of the second profile and the other of the two cut or separating sides, or second cut side. The latter, owing to the geometrical layout of the parts defined above, is substantially at right angles, or at right angles, to a longitudinal direction of the metal profile. Consequently, the engaging tongue may therefore interfere with the second profile in a transverse direction or direction of the short side of the metal profile. Owing to the fact that the hinge side is connected directly to said second cut side, the second cut side may remain in a stationary position during engagement.

In other words, the aforementioned arrangement is such that, in an engaged condition, the second cut side is firmly kept in position by the direct connection at one end to the hinge side. In this way, the fact that the second cut side intended to ensure engagement is kept in position by the direct connection to the hinge side, a stable engagement with the second profile may be obtained.

It may therefore be understood that, precisely because of the triangular shape of the engaging tongue and the arrangement of the hinge side not at right angles to the longitudinal direction of the profile, it is possible to obtain gentle and easy insertion of the engaging tongue inside the slot of the second profile, and at the same time firm and stable engagement.

It also follows that, only with such an arrangement and triangular shape of the engaging fin, is it possible to use plate-like portions with a small thickness, also of less than 0.25 mm, and obtain at the same time stable engagement of the engaging tongue. In fact, if the cut sides of the tongue intended to perform engagement were all free without direct connection to the hinge side, as occurs in the prior art with the hinge side at right angles and three cut sides, a reduction in the thickness of the profile would increase the risk of folding of the corners and of the hinge side, together with release of the engaged joint.

Even more particularly, if the cut sides of the tongue intended to perform engagement were all cut without direct connection to the hinge, end-to-end connection of two load-bearing profiles would also not be possible. In fact, the more thicknesses are reduced, the greater would be the risk of folding of the corners and release of the engaged joint.

In fact, two profiles which are joined end-to-end when installed are subject to loads which tend to move the two profiles away from each other. In this case, if the engaging tongue according to the prior art with a right-angled hinge side and three cut sides were present, in the case of a mutual separating action, there would be risk of the engaging tongues of the two profiles being raised and irreversibly folded, this resulting in irreversible slackening of the engaged joint.

The aforementioned configuration according to the present disclosure moreover does not prevent, but on the contrary favours, manual release of the tongue by an operator. In fact, once the engaging tongue has engaged inside the counter-engaging edge of the second profile, when an operator presses the tongue with a finger, the aforementioned second cut or separating side, which is situated directly against the second profile, is pressed into the second position in the plane of the plate-like portion and release of the second profile is possible. When performing this operation, the operator is assisted by having to move only a free corner between the first cut side and the second cut side. This condition ensures more reliable release when the operator presses the tongue.

This ease of operation may also be favoured by small thicknesses of the engaging tongue. Furthermore, the tongue may be pressed manually several times without altering its mechanical properties and without losing efficiency.

In one embodiment, with reference to when the metal profile is installed in a false ceiling, the two separating or cut sides intersect at a corner situated towards the top and the connecting side or hinge side is located towards the bottom, namely lower than said corner. In this way, an operator may act manually on the engaging tongue in the manner of push-button from below, since he/she is able to feel the hinge side with his/her finger and may press the engaging tongue towards the plate-like portion.

In some embodiments the connecting side or hinge side is arranged obliquely with respect to a longitudinal direction of the metal profile. Even more particularly, the engaging tongue is arranged so that, with respect to an ideal line extending in the longitudinal direction of the profile and crossing the engaging tongue passing through an angle of intersection between the first separating or cut side and the hinge side, the hinge side extends along an oblique line intersecting the ideal line on the side where the free edge of the plate-like portion is located. The two separating or cut sides intersect on the opposite side of the ideal line to the position of the hinge side.

Preferably, the oblique line extends from the central zone of the profile from the bottom upwards. In other words, the oblique line extends in a direction diverging from the free edge of the plate-like portion.

Owing to this oblique arrangement of the hinge side and the consequent arrangement of the separating sides it is possible to obtain a diverging displacement of the second cut side intended to interfere with the counter-engaging edge of the second profile, when the engaging tongue is displaced from the second position to the first rest position protruding from the plane of the plate-like portion. Essentially, when the engaging tongue is displaced between the position where the engaging tongue is pressed and the original position, the engaging tongue, and more particularly, the second cut side, performs a diverging movement which takes up the tolerances and the play generated during machining and assembly.

This compensation of the play eliminates or reduces the passive noise which may be produced by the vibrations of the ceiling or the building.

The divergence favours the movement of the tongue and reduces the risk of interference owing to the machining tolerances with the remaining plate-like portion during the movements between the first position and the second position.

In some embodiments, in order to contribute to the elastic behaviour of the engaging tongue, in addition to the form or shape described above, the integral engaging element is made of a material having a high elastic return, as defined in the international patent application PCT/IB2012/056221 in the name of the same inventor of the present patent application and cited herein in its entirety.

In particular, the metal profile and the respective integral engaging member are made of steel with a combination of the following mechanical properties:

maximum tensile strength Rm greater than 500 $N/mm^2$, and preferably between 650 and 850 $N/mm^2$; and elongation less than or equal to 15%, namely between 0 and 15%, preferably between 1 and 12% and even more preferably between 2 and 8%, wherein the term "maximum tensile strength" is understood as meaning the maximum load which can be withstood until breakage of the material occurs. The term "elongation" is understood as meaning the elongation at break of the steel. This data characterizes, partly, the deformation capacity of the steel.

In accordance with these latter embodiments, an integral engaging member and more particularly an engaging fin which has a high elastic return, both owing to the material from which it is made and owing to its form or shape, is therefore obtained.

In particular, in the opinion of the inventor of the present disclosure, the use of a material with an elastic capacity has provided an important contribution for arriving at the present disclosure and devising an engaging system with a fin suitably "cut" to have an elastic behaviour.

Furthermore, as mentioned, the fin may be pressed manually several times without altering its mechanical properties and without losing efficiency.

In some embodiments of the present disclosure the metal profiles are so-called load-bearing metal profiles and are designed to be connected "end-to-end", namely directly to each other by means of the mutual integral engaging members. In practice, according to the aforementioned embodiments, in a support structure for false ceilings, the load-bearing metal profiles are connected in pairs directly to each other.

In other embodiments of the present disclosure, the metal profiles are intended to form intersecting structures. For this purpose, it is pointed out that the load-bearing metal profile, or an intermediate metal profile, includes a slot formed in the main part. The integral engaging member of another metal profile and the integral engaging member of a further metal profile may be inserted on opposite sides inside the slot of the load-bearing metal profile or of the intermediate profile so as to be engaged with respective edges which define the slot of the load-bearing or intermediate metal profile. The three metal profiles form, as mentioned, an intersection zone, or cross-like configuration, of a structure for holding or supporting a false ceiling.

In practice, in accordance with these further embodiments, pairs of metal profiles are inserted, on opposite sides, inside the same slot of the load-bearing metal profile or intermediate profile and are both connected to opposite edges of the slot of the load-bearing metal profile or intermediate metal profile.

In other embodiments, the integral engaging member of a first metal profile is intended to be inserted on its own inside the slot of the load-bearing metal profile, for example along a side wall of the false ceiling, where an intersection cannot be formed.

Further characteristic features and modes of use forming the subject of the present disclosure will become clear from the following detailed description of examples of embodiment thereof, provided by way of a non-limiting example.

It should also be understood that the scope of the present disclosure includes all the possible combinations of embodiments described with reference to the following detailed description.

Reference will be made to the figures of the accompanying drawings in which.

Figure 1:
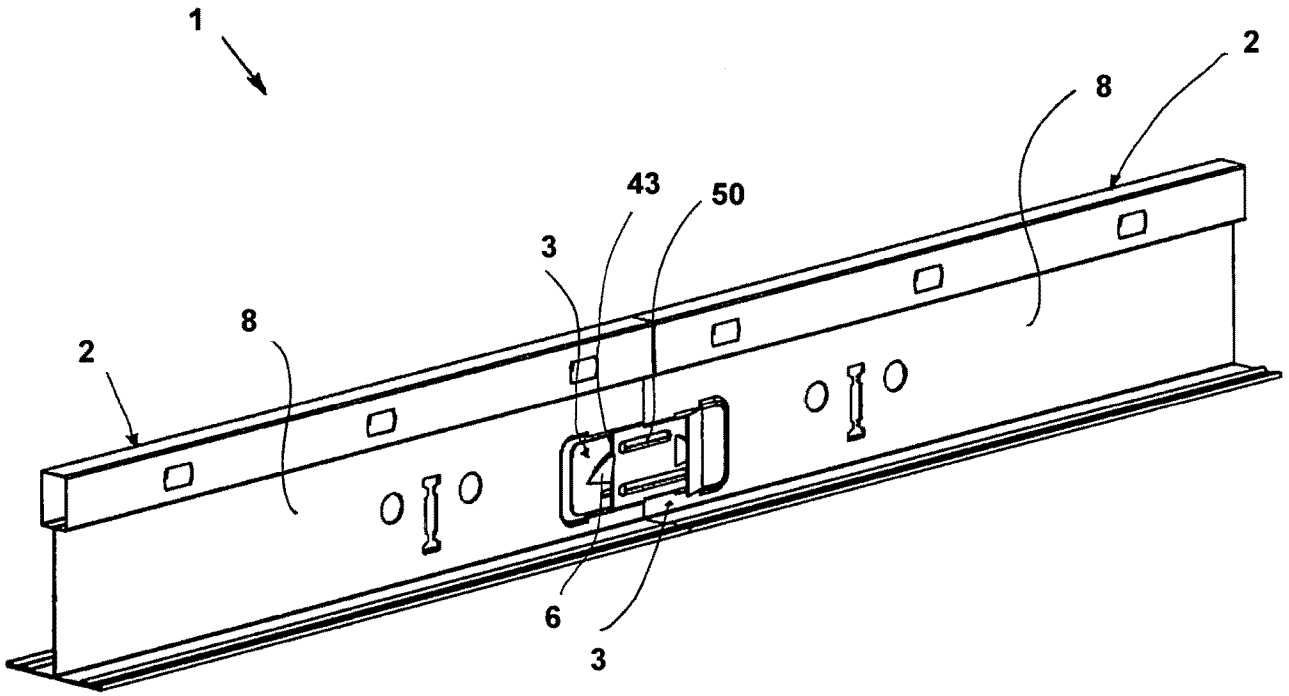
FIGS. 1 and 2 show respective perspective views of a support structure for false ceilings according to an embodiment of the present disclosure and in two different operating conditions.
Figure 2:
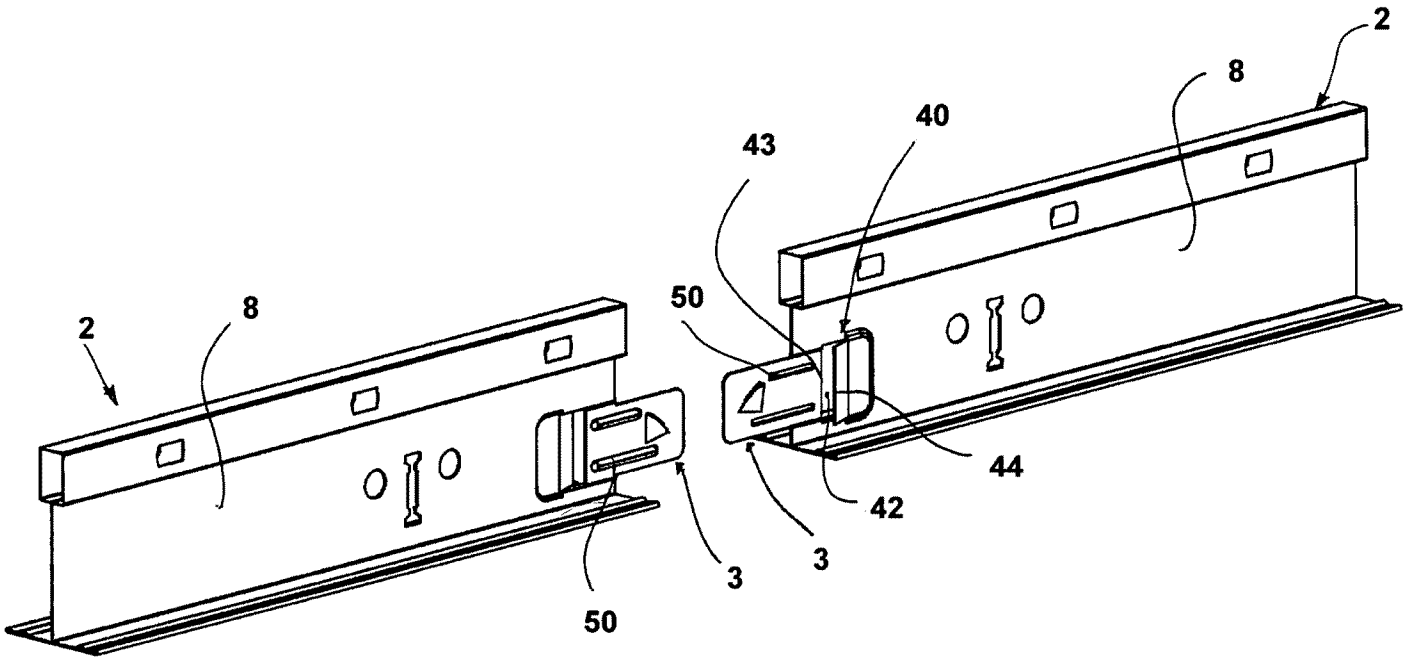
Figure 3:
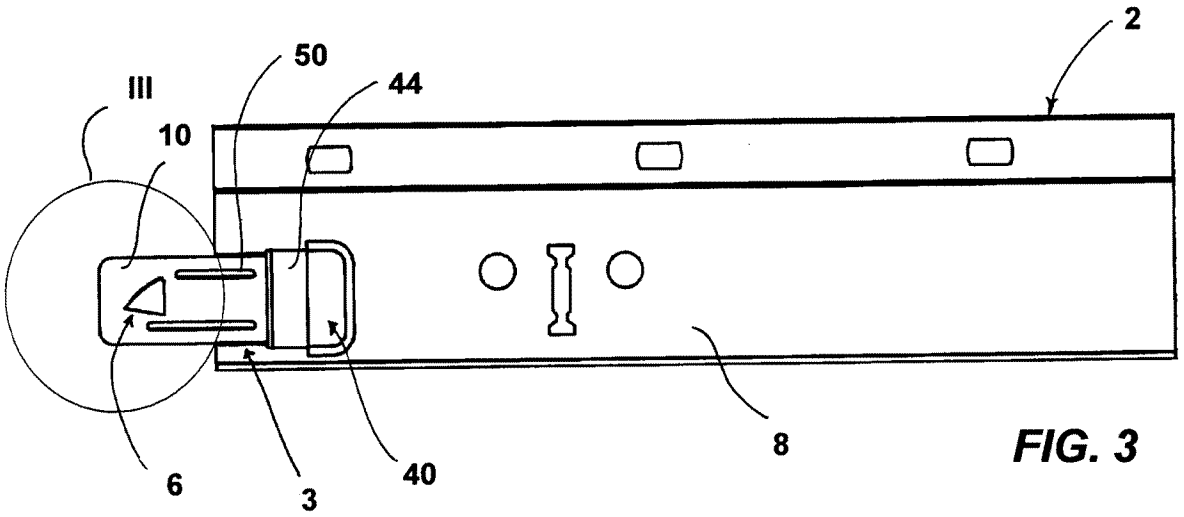
FIG. 3 shows a side view of a profile for false ceilings according to an embodiment of the present disclosure.
Figure 4:
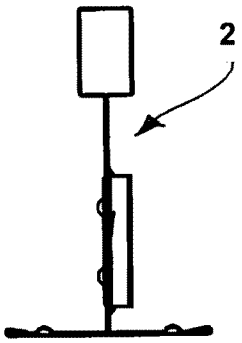
Figure 3A:
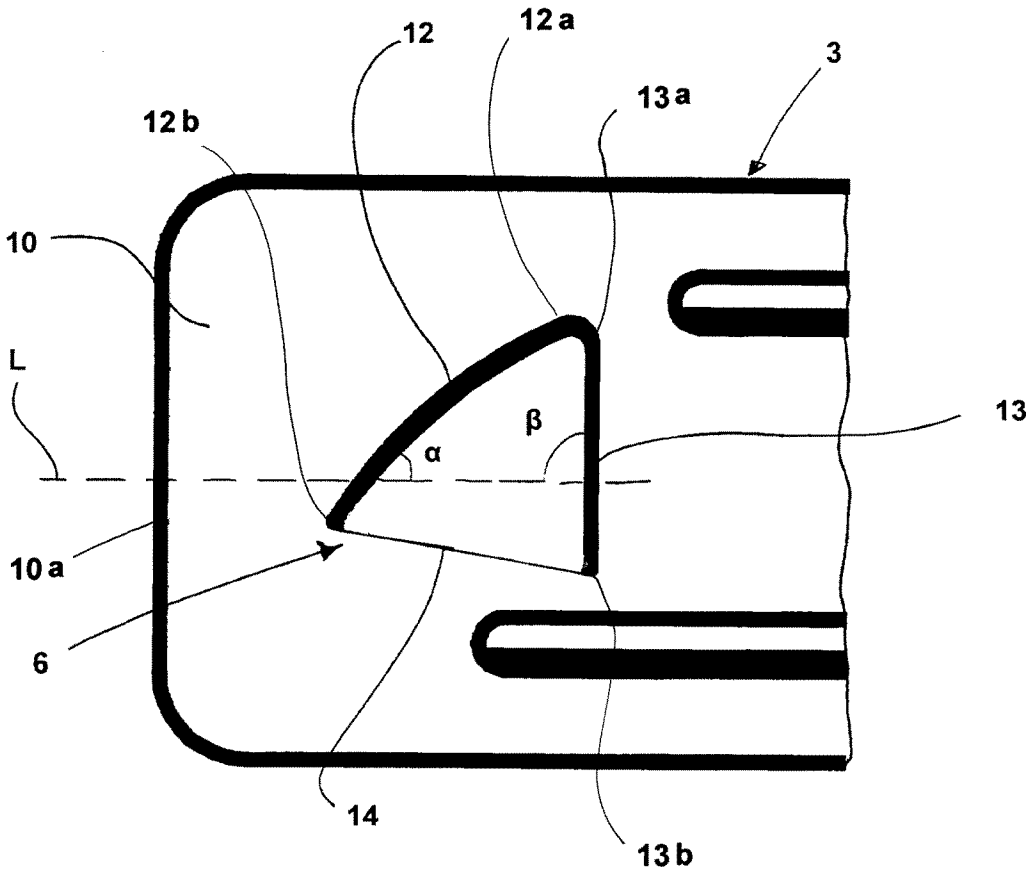
Figure 5:
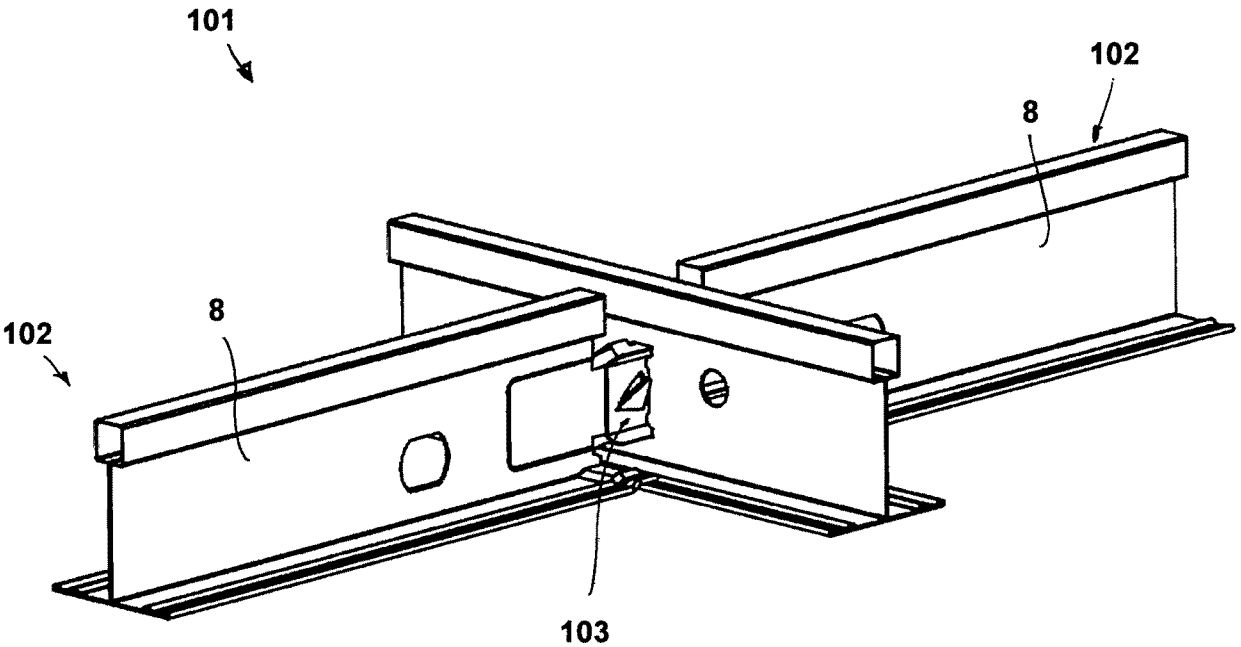
Figure 6:
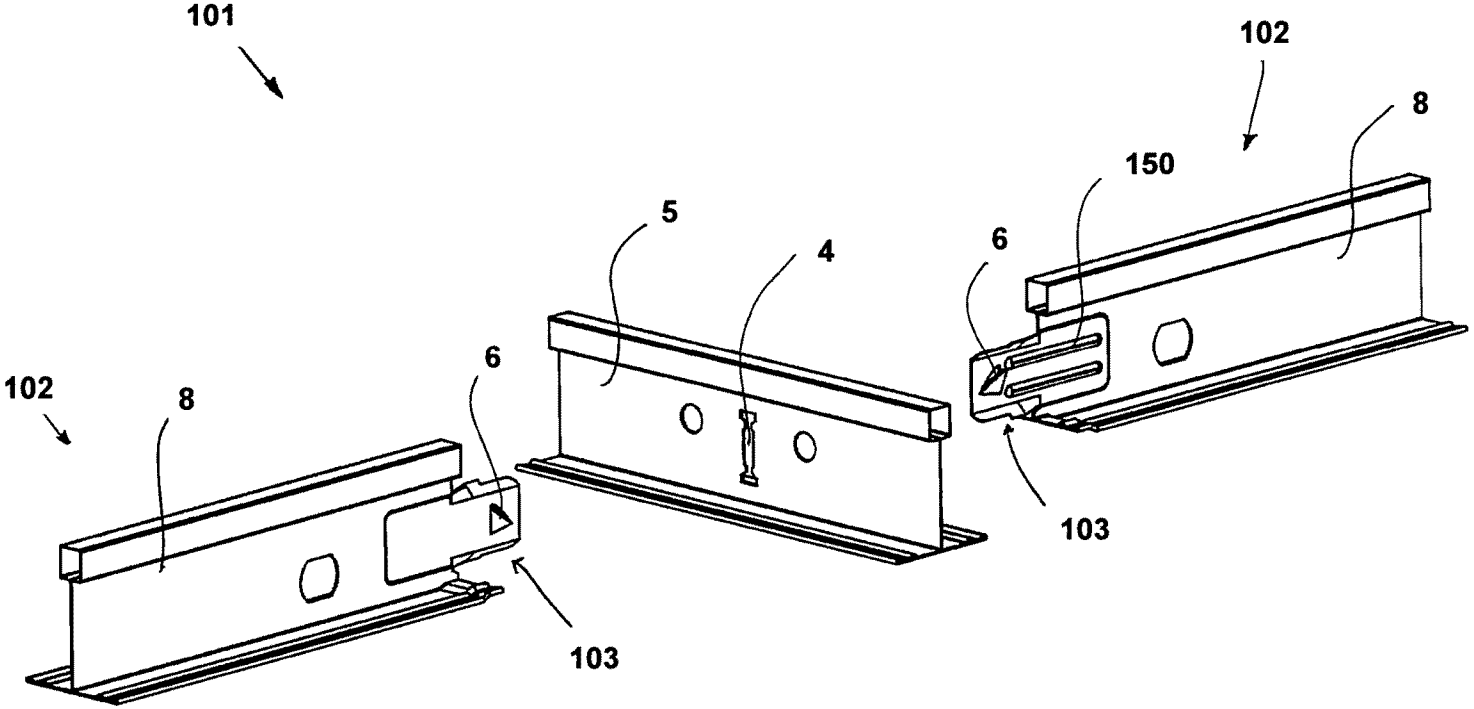
Figure 7:
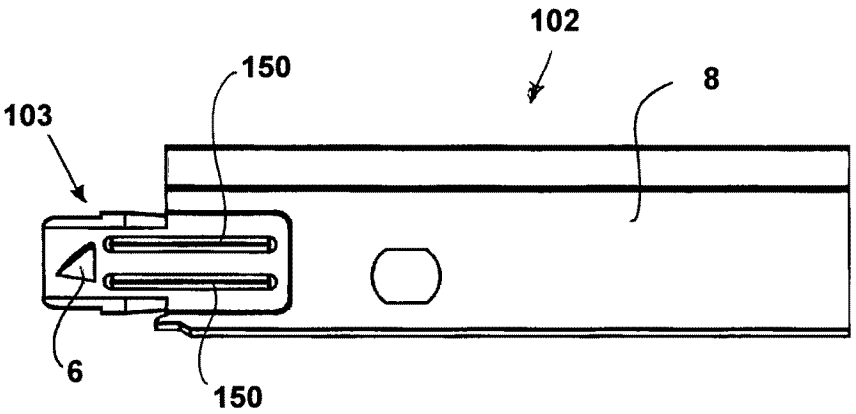
Figure 8:
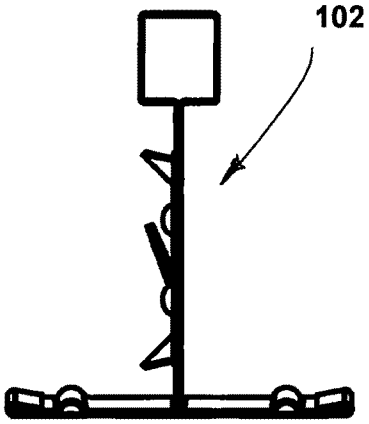
Figure 9:
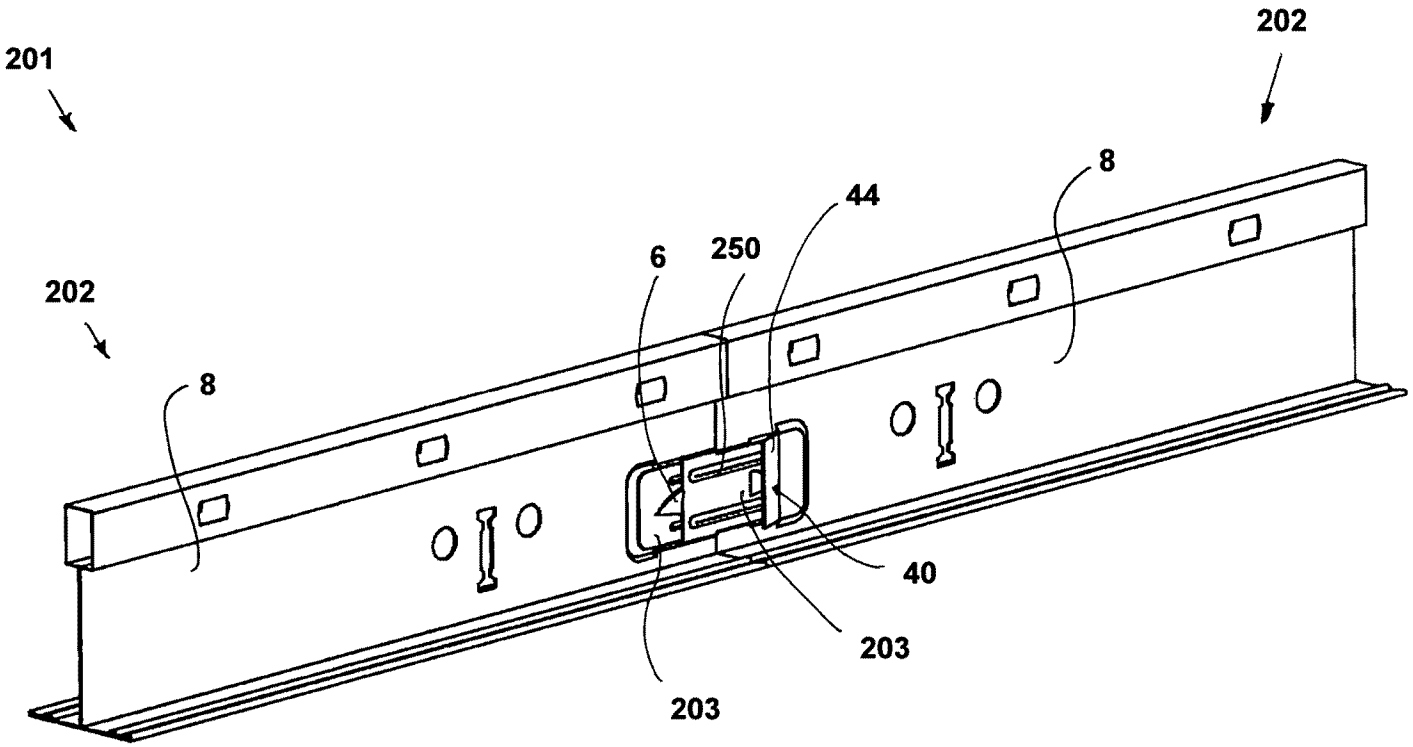
Figure 10:
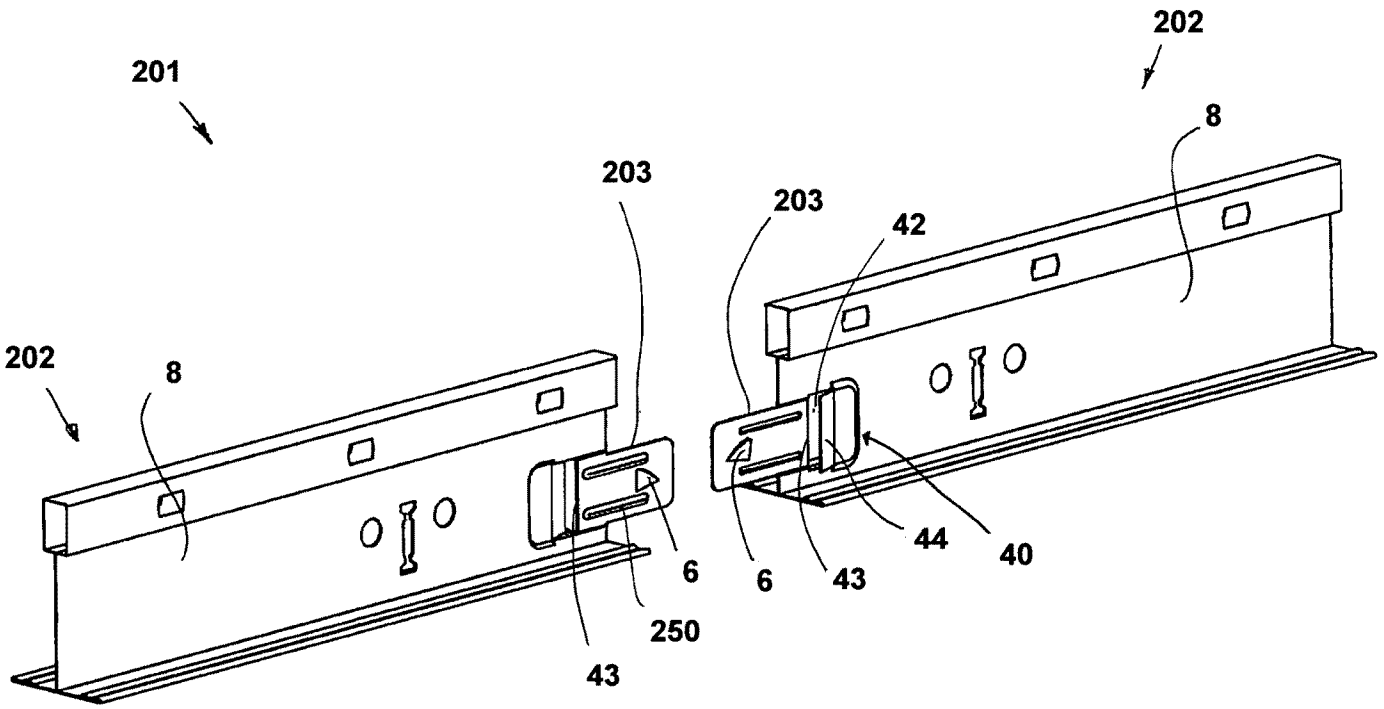
Figure 11:
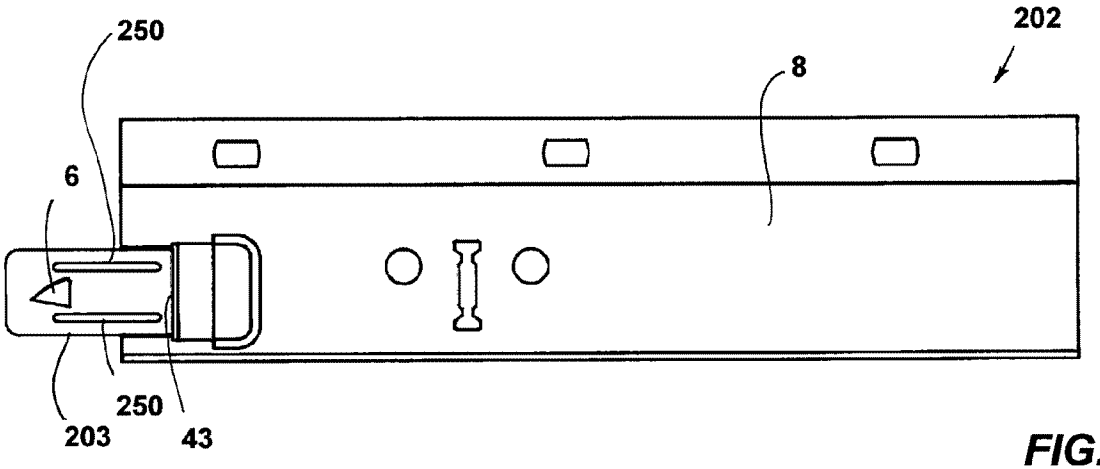
Figure 12:
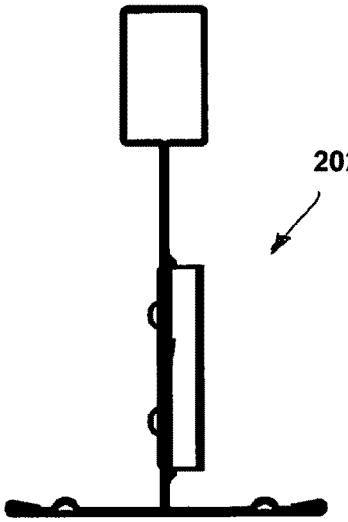
Figure 13:
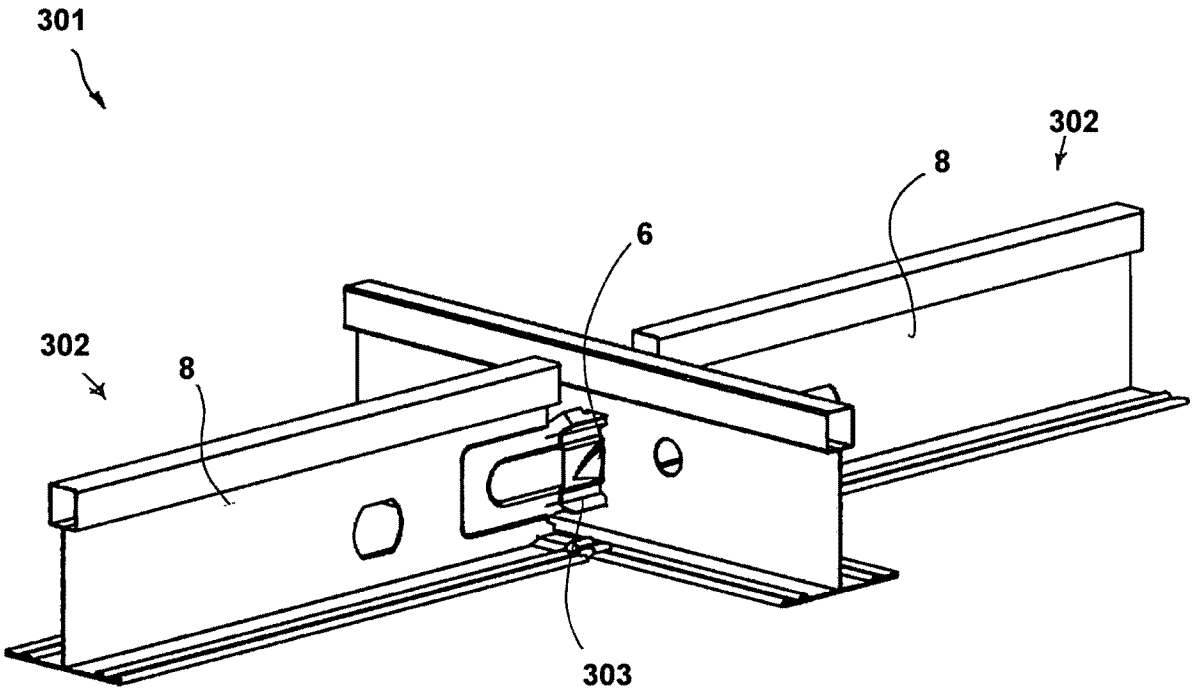
Figure 14:
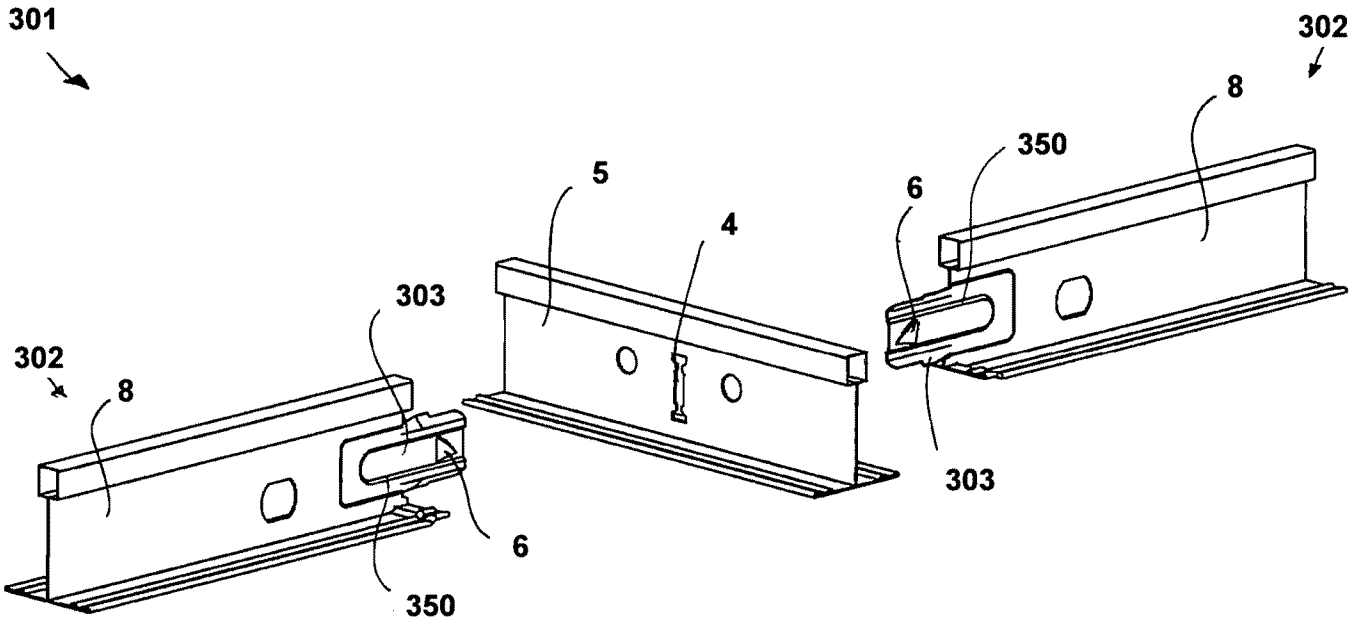
Figure 15:
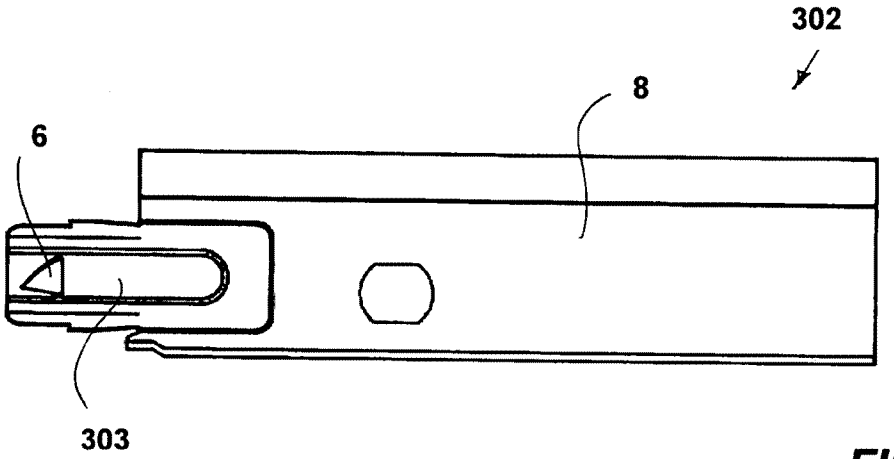
Figure 16:
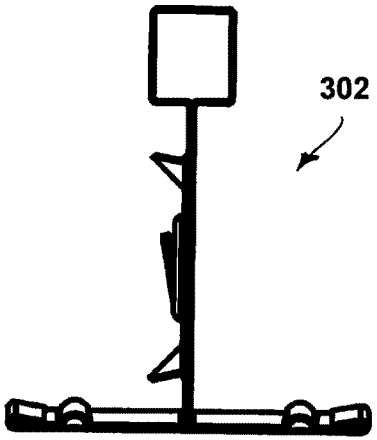

FIG. 3*a* shows a view, on a larger scale, of a detail III of FIG. 3;

FIG. 4 shows a further side view of a profile for false ceilings according to an embodiment of the present disclosure;

FIGS. 5 and 6 show respective perspective views of a support structure for false ceilings according to a further embodiment of the present disclosure and in two different operating conditions;

FIG. 7 shows a side view of a profile for false ceilings according to an embodiment of the present disclosure;

FIG. 8 shows a further side view of a profile for false ceilings according to an embodiment of the present disclosure;

FIGS. 9 and 10 show respective perspective views of a support structure for false ceilings according to a further embodiment of the present disclosure and in two different operating conditions;

FIG. 11 shows a side view of a profile for false ceilings according to an embodiment of the present disclosure;

FIG. 12 shows a further side view of a profile for false ceilings according to an embodiment of the present disclosure;

FIGS. 13 and 14 show respective perspective views of a support structure for false ceilings according to a further embodiment of the present disclosure and in two different operating conditions;

FIG. 15 shows a side view of a profile for false ceilings according to an embodiment of the present disclosure;

FIG. 16 shows a further side view of a profile for false ceilings according to an embodiment of the present disclosure.

With reference to the accompanying figures, the reference numbers 1, 101, 201 and 301 indicate respective support structures for false ceilings, each including pairs of metal profiles according to respective embodiments of the present disclosure. The metal profiles are denoted by the reference number 2, 102, 202, 302.

The metal profiles 2, shown in FIGS. 1-4, and the metal profiles 202, shown in FIGS. 9-12, are load-bearing profiles and are designed to be connected "end-to-end", namely directly to each other by means of mutual integral engaging members. 3 and 203. More particularly, each metal profile 2, 102, 202, 302 includes a main portion 8, to the end of which an integral engaging member 3, 103, 203, 303 is connected as a single body or as one piece.

The metal profiles 102, shown in FIGS. 5-8, and the metal profiles 302, shown in FIGS. 13-16, are metal profiles intended to form intersecting structures. In particular, a respective integral engaging member 103, 303 of a first metal profile 102, 302 may be inserted inside a slot 4 of a third metal profile 5 (load-bearing profile) so as to be engaged with an edge which defines the slot 4 in the third metal profile 5. inside the same slot, from another side of the third metal profile 5, an integral engaging member 103, 303 situated at the end of a second metal profile 102, 302 may be inserted, so as to form, as mentioned, an intersecting zone, or cross-like configuration, of a structure for holding or supporting a false ceiling.

It can be seen that, in the embodiments shown in the drawings, the metal profiles 2, 102, 202, 302, have a T-shaped cross-section and are obtained by means of folding of a metal sheet so as to obtain superimposition of two sheet-metal portions. Each metal profile 2, 102, 202, 302 may be different from those shown, for example with a different T-shaped cross-section/form specific for modular false ceilings.

All the metal profiles 2, 102, 202, 302, have in common a particular configuration and shape of an engaging fin or tongue 6 associated with the integral engaging member 3, 103, 203, 303 of each of the metal profiles 2, 102, 202, 302.

The engaging tongue 6 is, by way of example, shown in FIG. 3A in connection with the embodiment of the metal profile 2 shown in FIGS. 1-4. It is to be understood that the engaging tongue 6, while being described only in connection with the metal profile 2, is a characteristic feature common to the present disclosure and is to be regarded as included in all the other embodiments of metal profiles 102, 202, 302.

In particular, with reference to FIG. 3A, the integral engaging member comprises a plate-like portion 10 formed as one piece with the respective metal profile 2 and the engaging tongue or fin 6 connected, also as one piece, to the plate-like portion 10. The engaging tongue or fin 6 is detached or separated from said plate-like portion on at least two sides 12, 13 of said engaging tongue 6. In other words it consists of a fin which, owing to the two sides 12, 13, has a high degree of mobility. In fact, the engaging fin 6 has an optimum elastic return capacity owing to the presence of two sides which are cut with respect to the plate-like portion 10.

In accordance with certain embodiments such as those shown in the figures, the two sides of said engaging tongue 6 cut or separated with respect to the plate-like portion 10 are continuous and intersect so as to form an angle, which is for example acute. Even more particularly, the two sides 12, 13 of the engaging tongue 6 define a profile shaped like a "7".

The tongue 6 therefore has, for example, a substantially triangular shape or form, in which a third side 14 forms a connecting side or hinge side with the plate-like portion 10.

It can also be seen that one cut or separating side 13 is arranged transverse with respect to a longitudinal direction L, substantially at right angles or slightly oblique as described further below, so as to allow a suitable interference to be obtained with an edge, or counter-engaging edge, of the other metal profile.

It is also pointed that, in accordance with certain embodiments such as those shown in the figures, the cut sides 12, 13 are arranged or oriented in the following manner with respect to a long side or longitudinal direction L of the respective metal profile 2, 102, 202, 303.

In particular, "longitudinal direction" is understood as meaning the direction in relation to which the metal profile 2, 102, 202, 303 mainly extends and which is denoted by the reference letter L in FIG. 3A.

With respect to said longitudinal direction L, a first side 12 of the engaging tongue 6 extends diagonally or obliquely so as to intersect a line passing along said metal profile 2 parallel to the longitudinal direction L, forming an angle $\alpha$, and corresponds, in relation to the aforementioned triangle, substantially to the hypotenuse of the triangle. A second side 13, as mentioned above, is arranged in a transverse direction substantially or nearly at right angles to the longitudinal direction L. Basically, the second side 13 forms a greater angle $\beta$ with the longitudinal direction L, than the angle $\alpha$ formed by the first side 12 with the longitudinal direction L. As mentioned above, the arrangement of the side 13 described here allows both easy insertion of the engaging tongue inside the slot of the other profile and, at the same time, a high degree of interference of the engaging tongue 6 with the other profile 2, 102, 202, 302 or with the edge of the slot 4 in the profile 5, so as to ensure optimum mechanical stability of the engaging joint.

The hinge side 14 is arranged so as to be slightly diagonal or oblique with respect to the longitudinal direction L.

It is also commented that, by exerting a pressure on the engaging fin 6, the latter may be displaced from a rest condition in which the engaging fin 6 protrudes from the plate-like portion 10, into a deformed condition in which the engaging fin 6 is arranged substantially in a plane of the plate-like portion 10, so as to allow release of the engagement with the other profile 2, 102, 202, 302, or with the edge of the slot 4 of the profile 5. The slightly oblique arrangement of the hinge side 14 may favour a displacement of the fin 6 in a diverging direction upon displacement from the rest condition into the protruding condition, thus avoiding interference with the plate-like portion 10.

In other words, with reference to FIG. 3A, the engaging tongue 6 is arranged so that the second cut side 13 is located with respect to the first cut side 12, further towards a central or inner zone of the metal profile. The first cut side 12 therefore has a first free end 12*a* directed towards an inner zone and connected to a first end 13*a* of the second cut side 13, so as to form a free vertex of the triangle. The first cut side 12*a* has a second end 12*b* fastened and connected to the hinge side 14. The second cut side 13 therefore has the first end 13*a* free and a second end 13*b* connected to the hinge side 14. The second cut side 13 therefore has a free end 13*a* and a constrained end 13*b*

This arrangement is such that the engaging tongue 6 has a surface wall inclined towards the free edge 10*a* of the plate-like portion 10 so as to allow practical engagement of the engaging tongue. In fact, in order to engage the engaging tongue 6, the counter-engaging edge of the second profile may slide on the wall of the engaging tongue, which acts as a inclined surface or guiding surface for the counter-engaging edge of the second profile, thereby assisting sliding of the counter-engaging edge of the second profile along the engaging tongue 6 and consequent engagement of the engaging tongue.

Engagement takes place between the counter-engaging edge of the second profile and the other of the two cut or separating sides, or second cut side 13. The latter, owing to the geometrical lay-out of the parts defined above, is substantially at right angles, or at right angles, to a longitudinal direction of the metal profile, and connected/fastened at one end 13*b* to the hinge side. Consequently, the engaging tongue may therefore interfere with the second profile in a transverse direction or direction of the short side of the metal profile, and in a very firm/stable manner, owing to the fact that it is directly fastened to the hinge side 14.

This configuration moreover does not prevent, but on the contrary favours, manual release of the tongue by an operator. In fact, once the engaging tongue has engaged inside the counter-engaging edge of the second profile, when an operator presses the tongue, for example with a finger, the aforementioned second cut or separating side 13 which, according to the aforementioned geometrical layout, is situated, as mentioned, directed towards the central zone of the metal profile is pressed into the second position in the plane of the plate-like portion and release of the second profile is possible. The operator must feel with his/her finger only the downwards movement of the free corner at the two ends 12*a* and 13*b* of the two cut sides 12 and 13.

In the light of this description it is clear how the triangular form and the aforementioned arrangement are able to provide the desired results of gentle inserting action and stable engagement, also with engaging tongues which have a small thickness.

Preferably, in an embodiment such as that shown, the hinge side 14 and the first 12 of the two cut sides, or first cut side 12, converge towards a free edge end 10*a* of the plate-like portion 10.

In one embodiment, with reference to when the metal profile is installed in a false ceiling, the two separating or cut sides 12, 13 intersect at a corner situated towards the top and the connecting side 14 or hinge side is situated towards the bottom. In this way, the operator may manually operate the engaging tongue in the manner of a pushbutton from below.

Even more particularly, the engaging tongue 6 is arranged so that, with respect to an ideal line extending in the longitudinal direction of the profile and crossing the engaging tongue passing through an angle of intersection between the first 12 of the two separating or cut sides and the hinge side 14, the hinge side extends along an oblique line intersecting the ideal line (on the side where the free end edge 10*a* of the plate-like portion 10 is located). The two separating or cut sides 12, 13 intersect on the opposite side of the ideal line to the position of the hinge side 14.

The hinge side 14 therefore diverges in the direction from the free edge zone 10*a* towards an inner zone of the profile.

Consequently, owing to the oblique position of the hinge side 14, the second cut side 13 is located, in the embodiment shown, at right angles to the longitudinal direction when it is in the pressed position and is oblique with respect to the longitudinal direction when it is in the original rest position. The second cut side 13 therefore performs a rotation between the pressed position and the rest position. This rotational movement is such as to produce a recall action on the counter-engaging edge of the second profile until the play is completely eliminated.

In further embodiments, such as those shown in the figures, in order to contribute to the elastic behaviour of the engaging tongue 6, in addition to the form or shape described above, the integral engaging element 3, 103, 203, 303 is made of a material having a high elastic return, as defined in the international patent application PCT/IB2012/056221 in the name of the same inventor of the present patent application and cited herein in its entirety.

In particular, the metal profile 2, 102, 202, 302 and the respective integral engaging member 3, 103, 203, 303 are made of steel with a combination of the following mechanical properties:

maximum tensile strength Rm greater than 500 N/mm$^2$, and more particularly between 500 N/mm$^2$ and 1000 N/mm$^2$; and elongation of between 0% and 15%.

Basically, the metal profile has a high hardness and low elongation factor. In one embodiment of the present disclosure, the metal profile 2, 102, 302 has the following mechanical properties:

maximum tensile strength Rm of between 650 and 850 N/mm$^2$; and elongation of between 1% and 12% or elongation of between 2% and 8% wherein these mechanical properties have proved to be capable of obtaining improved results. The metal profile therefore consists of a steel profile with a low elongation factor and high strength, and consequent high elastic return.

The steel may be galvanized steel, non-stainless steel, or painted steel, or steel lined in a different way. In some embodiments, in the case of high-quality low-cost manufactured products, the steel is not lined.

In accordance with said properties and as mentioned above, the steel strip may have a very small thickness of the order of 0.10-0.25 mm. Owing to the fact that the metal profile has these mechanical properties of a high mechanical strength and low elongation, with consequent improved elastic properties, the fin 6 may be operated easily and reliably by an operator. In fact, owing to the fact that the integral engaging member 3, 103, 203, 303 and the engaging tongue 6 are made as one piece with the respective profiles 2, 102, 202, 302, the integral engaging member 3, 103, 203, 303 and the engaging tongue 6 may exploit the same elastic properties of the profile.

With reference to the accompanying figures, the single integral engaging members 3, 103, 203, 303 of the respective profiles 2, 102, 202, 302 are described in detail.

The metal profiles 2 shown in FIGS. 1-4 and the metal profiles 202 shown in FIGS. 9-12 are, as mentioned, load-bearing profiles and are designed to be connected "end-to-end", namely directly to each other by means of mutual integral engaging members 3 and 203. The metal profiles 2, 202 differ from each other mainly owing to an arrangement of respective reinforcing ribs 50, 250 associated with the plate-like portions 10 which allows the plate-like portions 10 to be provided with sufficient rigidity to keep the plate-like portions 10 in an aligned position during an engaging step.

The integral engaging members 3 and 203 have a pocket structure 40 situated in a connection zone between the plate-like portion 10 and the remaining part 8 of the profile 2 and 202. This pocket structure 40 is intended to receive the engaging tongue 6 of the other profile 2 and 202.

In particular, this pocket structure 40 defines a cavity or opening 42 in the profile 2 and 202, a counter-engaging edge 43 and a wall 44 protruding from the plate-like portion 10. The wall 44 protrudes from the same side of the profile 2, 202 from which the engaging fin 6 protrudes, as can be seen for example in FIG. 4 and FIG. 12.

It can be seen that, in order to obtain engagement, the two profiles are moved towards each other so that the plate-like portions 10 slide on each other in mutual pressing contact until each of the plate-like portions 10 of the two profiles 2, 202 are partially accommodated inside the pocket structure 40 of the other profile 2, 202.

In particular, in the engaged condition, the plate-like portion 10 is partially accommodated inside the cavity 42 underneath the wall 44 of the other profile, so that the engaging fin or tongue 6 engages with the counter-engaging edge 43 of the other profile.

More particularly, owing to the elastic deformability of the engaging tongue 6, the engaging tongue 6 is momentarily pressed against the plate-like portion 10 of the other profile during sliding, until engagement occurs when it reaches the cavity 42 and the edge 43 of the other profile.

Even more particularly, in the engaged condition, the separating side 13 of the engaging fin or tongue 6 engages with the counter-engaging edge 43.

In order to release the profiles, it is sufficient to press the two engaging tongues 6 in opposite directions towards the respective metal profiles 2, 202 and at the same time separate the two profiles 2, 202, moving them away from each other in opposite directions.

In connection with the metal profiles 102, shown in FIGS. 5-8, and the metal profiles 302, shown in FIGS. 13-16, which are metal profiles intended to form intersecting structures, it can be seen that each of these metal profiles 102, 103 has a respective plate-like portion 10, which is shaped so as to complement the slot 4 of the profile 5 and allow positive and guided insertion inside the slot 4.

In the engaged condition, owing to the configuration described above, it is possible to obtain a smooth guiding action of the engaging tongue 6 until it engages with the edge of the slot. In fact, during initial sliding inside the slot, the engaging fin or slot 6 is pressed momentarily against the edge of the slot until engagement occurs, when it reaches the edge of the profile 5.

Even more particularly, in the engaged condition, the separating side 13 of the engaging fin or tongue 6 engages with the counter-engaging edge 43 of the profile 5 which defines the slot 4.

The metal profiles 102, 302 differ from each other mainly owing to an arrangement of respective reinforcing ribs 150, 350 which are associated with the plate-like portions 10 and which allow the latter to be provided with a sufficient rigidity to keep the plate-like portions 10 in an aligned position during an engaging step.

It should be pointed out that the ribs 50, 150, 250, 350 may be replaced with downwardly directed depressions or padding elements which all have a reinforcing function.

The subject of the present disclosure has been described hitherto with reference to preferred examples of embodiment thereof. It is to be understood that other embodiments relating to the same inventive idea may exist, all of these falling within the scope of protection of the claims which are illustrated hereinbelow.

The invention claimed is:

1. A metal profile for a false ceiling, the metal profile including a main portion and an integral engaging member connected as a single body, or as one piece, to at least one end of the main portion, wherein said integral engaging member includes a plate portion and an engaging tongue or fin connected as one piece to the plate portion, wherein the metal profile is made of a steel strip or sheet metal of thickness equal to or lower than 0.25 mm, wherein the steel presents the following combination of features:

maximum tensile strength Rm from 500 $N/mm^2$ to 1000 $N/mm^2$; and elongation from 2% to 8%, said engaging tongue or fin is detached or separated from said plate portion on two cut sides of said engaging tongue, the two cut sides of said engaging tongue with respect to the plate portion are adjacent and intersecting so as define a free edge or corner, the engaging tongue has one side connected to the plate portion, said side being a hinge side for both the cut sides of the engaging tongue so that the engaging tongue has a triangle shape:

a first cut side of said two cut sides has a first free end and a second end connected to the hinge side and a second cut side of said two cut sides is located, with respect to the first cut side, further towards an inner or central zone of the metal profile and wherein the second cut side is intended to interfere with a counter-engaging edge of another metal profile in a engaged condition, said second cut side having a first free end defining with the first end of the first cut side said free edge or corner and a second end forming a second end of said hinge side;

wherein said engaging tongue or fin is displaceable by means of elastic deformation between a first position in which the engaging fin is located in a rest condition protruding from a plane of the plate portion, and a second position in which said engaging fin is in a elastically deformed condition displaced towards the plane of the plate portion, and vice versa.

2. The metal profile according to claim 1, wherein the first cut side and the hinge side converge towards the free edge of the plate portion.

3. The metal profile according to claim 1, wherein the hinge side is arranged oblique with respect to a longitudinal direction of the metal profile.

4. The metal profile according to claim 1, wherein the hinge side is arranged not at right angles to a longitudinal direction of the metal profile.

5. The metal profile according to claim 1, wherein the second cut side is at right angles to a longitudinal direction of the profile when it is in the second position, and is oblique with respect to the longitudinal direction when it is in the first position, and wherein the second cut side performs a rotation when the engaging fin passes from the second position to the first position.

6. The metal profile according to claim 1, wherein said metal profile has a thickness in the region of 0.10 to 0.20 mm.

7. The metal profile according to claim 1, wherein said metal profile is a load-bearing profile, and includes a pocket structure defining a cavity and a counter-engaging edge, said pocket structure being intended to accommodate the plate portion of another metal profile and said counter-engaging edge being intended to interact with the engaging fin of said other metal profile.

8. The metal profile according to claim 7, wherein the pocket structure has a wall protruding from said plate portion, said protruding wall protruding from the same side of the plate portion as that from which the engaging fin protrudes.

9. A support structure for a false ceiling including at least one pair of metal profiles according to claim 7.

10. The support structure for a false ceiling according to claim 9, wherein, in an engaged condition of the two metal profiles, the plate portion of each metal profile is partially accommodated in a pocket structure of the other metal profile and said engaging fin of each metal profile interferes with the counter-engaging edge of the other metal profile.

11. The support structure for a false ceiling according to claim 10, wherein said metal profile includes a slot formed in the main portion, and wherein a further metal profile is inserted and engaged via said integral engaging member inside the slot, or wherein a pair of profiles are inserted and engaged on opposite sides inside the slot of the metal profile by means of respective integral engaging members, so as to obtain a cross-like configuration.

12. A metal profile for a false ceiling, the metal profile including a main portion and an integral engaging member connected as a single body, or as one piece, to at least one end of the main portion, wherein said integral engaging member includes a plate portion and an engaging tongue or fin connected as one piece to the plate portion, wherein said engaging tongue or fin is detached or separated from said plate portion on two cut sides of said engaging tongue, the two cut sides of said engaging tongue with respect to the plate portion are adjacent and intersecting so as define a free edge or corner, the engaging tongue has one side connected to the plate portion, said side being a hinge side for both the cut sides of the engaging tongue so that the engaging tongue has a triangle shape:

the first cut side of said two cut sides has a first free end and a second end connected to the hinge side and the second cut side of said two cut sides is located, with respect to the first cut side, further towards an inner or central zone of the metal profile and wherein the second cut side is intended to interfere with a counter-engaging edge of another metal profile in a engaged condition, said second cut side having a first free end defining with the first end of the first cut side said free edge or corner and a second end forming the second end of said hinge side;

wherein said engaging tongue or fin is displaceable by means of elastic deformation between a first position in which the engaging fin is located in a rest condition protruding from a plane of the plate portion, and a second position in which said engaging fin is in a elastically deformed condition displaced towards the plane of the plate portion, and vice versa, wherein the hinge side of the engaging tongue is arranged obliquely with respect to an ideal line which extends in the longitudinal direction of the profile, wherein the ideal line crosses the second cut side passing through an angle of intersection between the first cut side and the hinge side, said hinge side intersecting said ideal line on a side where the free edge of the profile is located, or diverging in a direction from said free edge to the inner zone of the profile.

13. The metal profile according to claim 12, wherein the metal profile and the respective integral engaging member are made of steel having a combination of the following mechanical properties:

maximum tensile strength Rm greater than 500 $N/mm^2$; and elongation of between 0% and 15%.

14. The metal profile according to claim 13, wherein said profile has a maximum tensile strength Rm of between 650 and 850 $N/mm^2$.

15. The metal profile according to claim 13, wherein said profile has an elongation of between 1% and 12%.

16. The metal profile according to claim 13, wherein said profile has an elongation of between 2% and 8%.

17. A metal profile for a false ceiling, the metal profile including a main portion and an integral engaging member connected as a single body, or as one piece, to at least one end of the main portion, wherein said integral engaging member includes a plate portion and an engaging tongue or fin connected as one piece to the plate portion, wherein said engaging tongue or fin is detached or separated from said plate portion on two cut sides of said engaging tongue, the two cut sides of said engaging tongue with respect to the plate portion are adjacent and intersecting so as define a free edge or corner, the engaging tongue has one side connected to the plate portion, said side being a hinge side for both the cut sides of the engaging tongue so that the engaging tongue has a triangle shape:

the first cut side of said two cut sides has a first free end and a second end connected to the hinge side and the second cut side of said two cut sides is located, with respect to the first cut side, further towards an inner or central zone of the metal profile and wherein the second cut side is intended to interfere with a counter-engaging edge of another metal profile in a engaged condition, said second cut side having a first free end defining with the first end of the first cut side said free edge or corner and a second end forming the second end of said hinge side;

wherein said engaging tongue or fin is displaceable by means of elastic deformation between a first position in which the engaging fin is located in a rest condition protruding from a plane of the plate portion, and a second position in which said engaging fin is in a elastically deformed condition displaced towards the plane of the plate portion, and vice versa, wherein, with reference to when the metal profile is installed in a false ceiling, the two cut sides intersect each other at a corner towards the top and the hinge side is situated lower than said corner.

18. A metal profile for a false ceiling, the metal profile including a main portion and an integral engaging member connected as a single body, or as one piece, to at least one end of the main portion, wherein said integral engaging member includes a plate portion and an engaging tongue or fin connected as one piece to the plate portion, wherein said engaging tongue or fin is detached or separated from said plate portion on two cut sides of said engaging tongue, the two cut sides of said engaging tongue with respect to the plate portion are adjacent and intersecting so as define a free edge or corner, the engaging tongue has one side connected to the plate portion, said side being a hinge side for both the cut sides of the engaging tongue so that the engaging tongue has a triangle shape:

the first cut side of said two cut sides has a first free end and a second end connected to the hinge side and the second cut side of said two cut sides is located, with respect to the first cut side, further towards an inner or central zone of the metal profile and wherein the second cut side is intended to interfere with a counter-engaging edge of another metal profile in a engaged condition, said second cut side having a first free end defining with the first end of the first cut side said free edge or corner and a second end forming the second end of said hinge side;

wherein said engaging tongue or fin is displaceable by means of elastic deformation between a first position in which the engaging fin is located in a rest condition protruding from a plane of the plate portion, and a second position in which said engaging fin is in a elastically deformed condition displaced towards the plane of the plate portion, and vice versa, wherein the first cut side of said two cut sides of the engaging tongue extends diagonally or obliquely with respect to a longitudinal direction of said profile and the second cut side of said two cut sides of the engaging tongue is arranged so as to define, with the longitudinal direction, an angle greater than an angle of said first side.

19. The metal profile according to claim 18, wherein said angle between the second cut side and the longitudinal direction is 90°.

* * * * *